US005873972A

United States Patent [19]

Barnett

[11] Patent Number: 5,873,972

[45] Date of Patent: Feb. 23, 1999

[54] PROTECTIVE FLOOR RUNNER AND METHOD OF USING SAME

[76] Inventor: Terry R. Barnett, 20389 Weiland Rd., Prairie View, Ill. 60069

[21] Appl. No.: 902,660

[22] Filed: Jul. 30, 1997

[51] Int. Cl.[6] ..... B32B 35/00; B32B 3/06

[52] U.S. Cl. ..... 156/270; 428/192; 404/12

[58] Field of Search ..... 404/12; 156/270; 428/192, 194

[56] References Cited

U.S. PATENT DOCUMENTS

| | | |
|---|---|---|
| D. 208,350 | 8/1967 | Cheris . |
| D. 216,656 | 2/1970 | Horwich . |
| 1,638,254 | 8/1927 | Freyburg et al. . |
| 1,752,535 | 4/1930 | Millholland . |
| 1,959,413 | 5/1934 | Drew . |
| 2,185,470 | 1/1940 | MacDonald et al. . |
| 2,229,316 | 1/1941 | Van Cleef . |
| 2,502,749 | 4/1950 | Reid . |
| 2,653,885 | 9/1953 | Harper . |
| 3,936,207 | 2/1976 | Sticha . |
| 4,443,510 | 4/1984 | Sticha . |
| 5,437,907 | 8/1995 | Peil et al. . |
| 5,601,900 | 2/1997 | Doscher . |

*Primary Examiner*—Alexander Thomas
*Attorney, Agent, or Firm*—Meroni & Meroni

[57] ABSTRACT

A floor runner is disclosed for providing path of travel across a floor. The floor runner includes an elongated sheet in rolled form. The sheet is formed of a flexible plastic material having a bottom surface containing an adhesive applied thereto. The sheet has outer spaced apart parallel colored edges extending along the length. The colored edges are distinguishable from the generally translucent central portion of the sheet with the colored edges defining a path of travel therebetween. Further, a method of using the floor runner is disclosed where the floor runner has severed portions or lengths disposed transversely against a length of floor runner extended along a floor. The colored edges of the severed length and floor runner form a generally square-shaped colored perimeter viewable by a user to alert the user of an obstacle positioned therebelow.

8 Claims, 2 Drawing Sheets

PROTECTIVE FLOOR RUNNER AND METHOD OF USING SAME

BACKGROUND OF THE INVENTION

1. Field of the Invention

The present invention relates generally to floor runners. More particularly, the invention pertains to protective plastic floor runners and a method of using same.

2. Description of the Prior Art

Various types of floor runners are known in the art for use on floors or carpets for a variety of different applications. For example, floor runners are commonly placed in high-traffic areas to protect the underlying floor from dirt or wear.

Typically, floor runners are formed of a synthetic plastic material and are provided in a rolled form. Common high-traffic uses of floor runners include convention halls and model homes, where the floor runner is often designed to protect a carpet. However, in such applications where a continuous length of floor runner is extended across a floor, it has been found that it is often necessary to cross over obstacles on the floor, such as power cords and the like, which creates a significant safety risk to those persons walking or moving along the floor runner.

As will be described in greater detail hereinafter, the floor runner and method of using same of the present invention solves the aforementioned problem and employs a number of novel features that render it highly advantageous over the prior art.

SUMMARY OF THE INVENTION

Accordingly, it is an object of this invention to provide a protective floor runner having an adhesive backing for secured placement of the floor runner on a floor or carpet.

Another object of this invention is to provide a floor runner having colored edges to alert a user of the location of floor runner for purposes of directing the user to walk between the color edges.

Still another object of this invention is to provide a floor runner having severed portions or lengths for placement transversely against a length of floor runner extended along a floor. The colored edges of the severed length and floor runner forming a generally square-shaped colored perimeter viewable by a user to alert the user of an obstacle positioned therebelow. Further, the obstacle is secured and held in position by the present invention.

To achieve the foregoing and other objectives, and in accordance with the purposes of the present invention a floor runner is disclosed for providing path of travel across a floor. The floor runner is comprised of an elongated sheet in rolled form. The sheet is formed of a flexible plastic material having a bottom surface containing an adhesive applied thereto. The sheet has outer spaced apart parallel colored edges extending along the length. The colored edges are distinguishable from the generally translucent central portion of the sheet with the colored edges defining a path of travel therebetween.

In accordance with an aspect of the invention, a method is provided for protecting a floor and alerting users thereupon of obstacles crossing a designated path. The method comprises the steps of: (a) providing plastic sheeting in rolled form, the plastic sheeting having outer spaced apart parallel colored edges extending along the length; (b) unrolling the plastic sheeting along a floor with adhesive of the bottom surface securing the plastic sheeting in removable engagement with the floor, the plastic sheeting being rolled over obstacles lying in the path of travel formed between the colored edges of the plastic sheeting; (c) cutting the plastic sheeting to sever an unrolled portion of the plastic sheeting to form a first length of the plastic sheeting; (d) unrolling the plastic sheeting transversely across the first length of plastic sheeting at a position corresponding to an obstacle underlying the first length of plastic with the bottom surface the plastic sheeting in lapped engagement with a top surface of the first length of the plastic sheeting; and (e) cutting the plastic sheeting to sever a second unrolled portion of the plastic sheeting to form a second length of the plastic sheeting, the second length of plastic having outer spaced apart parallel colored edges extending along the length, the colored edges being distinguishable from the generally translucent central portion of the second length of plastic sheeting, the colored edges of the first and second lengths of plastic sheeting forming a generally square-shaped colored perimeter viewable by a user to alert the user of the obstacle positioned therebelow.

Other objects, features and advantages of the invention will become more readily apparent upon reference to the following description when taken in conjunction with the accompanying drawings, which drawings illustrate several embodiments of the invention.

DETAILED DESCRIPTION OF THE PREFERRED EMBODIMENT

Figure 1:
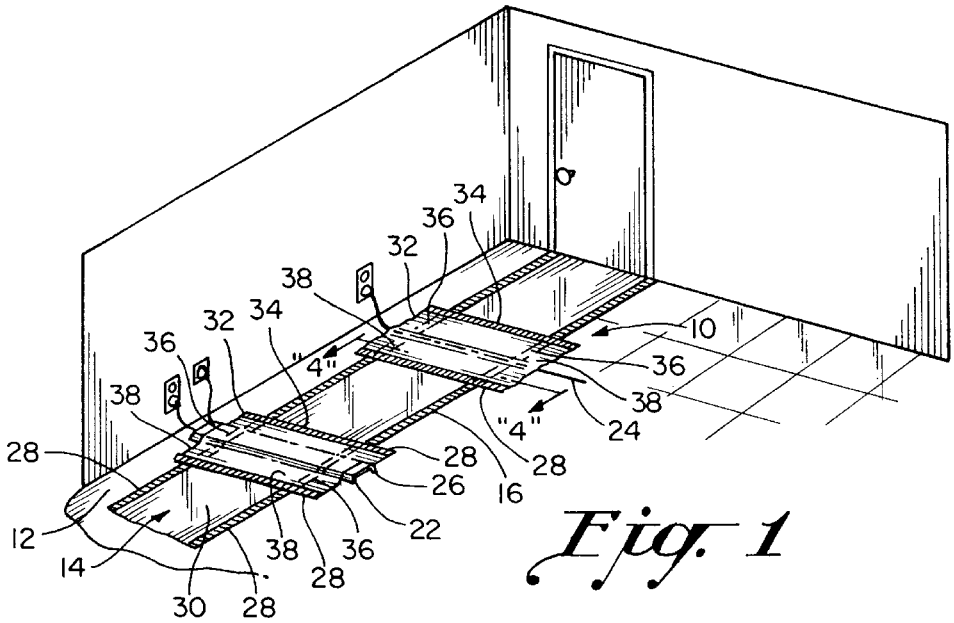
FIG. 1 is a perspective view of the present invention extended across a floor.

Referring now to the drawings, a floor runner or structure 10 is illustrated in FIG. 1. The floor runner 10 is extendable across a floor 12 to provide a path of travel 14.

Figure 2:
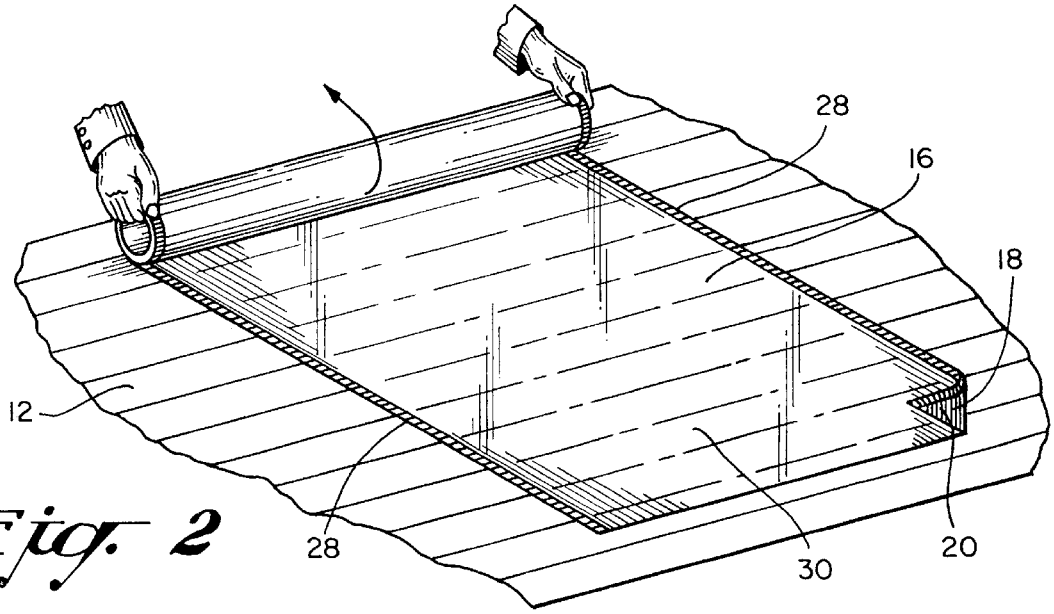
FIG. 2 is a perspective view of a sheet of plastic material of the present invention in rolled form.

Referring to FIG. 2, the floor runner 10 is preferably comprised of an elongated sheet or sheeting 16 in rolled form. The sheet 16 is formed of a thin flexible synthetic plastic material having a bottom surface 18 containing a water soluble adhesive 20 applied thereto, where the adhesive 20 is non-transferring to the floor for a period of time, such as 40–60 days. The sheet preferably has a width of at least 20 inches to allow sufficient space to allow a person to walk across.

In use, the plastic sheet 16 is unrolled along the floor 12 with the adhesive 20 of the bottom surface 18 securing the plastic sheet 16 in removable engagement with the floor 12 so that the plastic sheet 16 remains in fixed position with the floor 12, while at the same time being readily removable and peeled from the floor 12 without causing damage. When unrolled, the plastic sheet 16 is extended or rolled over obstacles 22 lying in the path of travel 14. For example, referring to FIG. 1, the obstacles may include power cords 24 or power cord strips 26.

The sheet 16 has outer spaced apart parallel colored edges 28 extending along the length of the sheet 16. The colored edges 28, such as high-visibility yellow or orange, are thereby distinguishable from the generally translucent central portion 30 of the sheet 16 with the colored edges 28 defining the path of travel 14 therebetween.

A severed length or second length 32 of the sheet 16 is cut from the rolled length sheet 16 with a utility knife 33 (FIG. 3) for placement in lapped engagement with the sheet or first length 16 with the severed length 32 extending transversely with the colored edges 28 of the sheet 16 being generally perpendicular with the colored edges 28 of the severed length 32. The colored edges 28 of the sheet 16 and severed length 32 forming a generally square-shaped colored perimeter 34 viewable by a user from above to alert the user of the obstacle 22 positioned therebelow. The portions 36 of the perimeter 34 formed by colored edges 28 of the sheet 16 are adjacent and underlying translucent portions 38 of the severed length 32.

Figure 3:
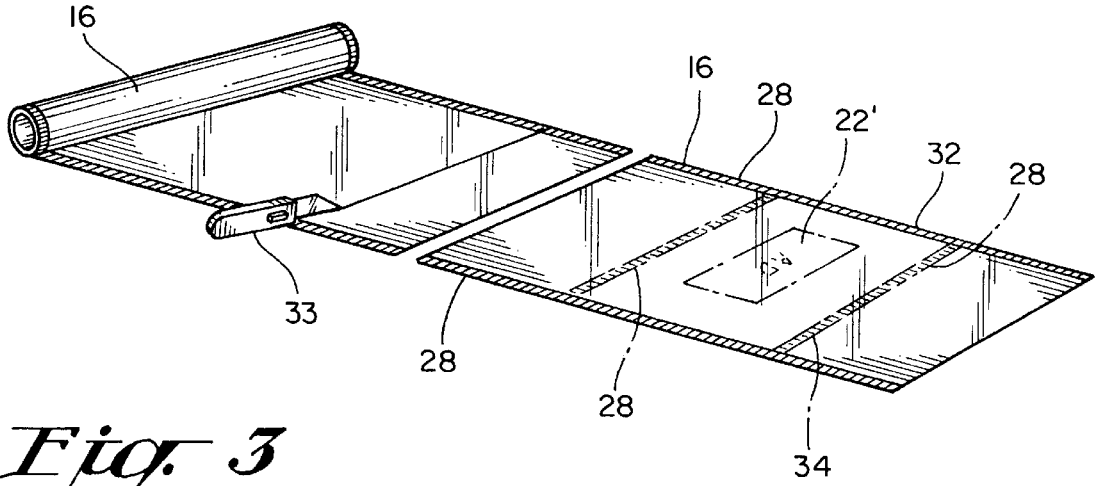
FIG. 3 is a perspective view of the sheet of plastic having a second portion in lapped engagement therewith.
Figure 4:
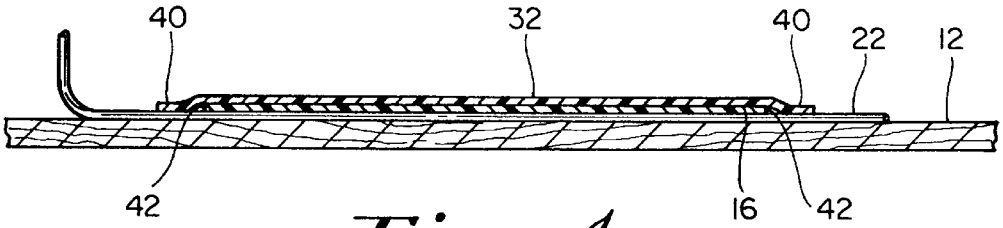
FIG. 4 is a sectional view taken along line 4—4 of FIG. 1.

Referring to FIG. 3, the length of the severed length 32 is approximately as long as the width of the sheet 16. As an additional feature of the present invention illustrated FIGS. 1 and 4, opposite ends 40 of the severed length 32 are extended outwardly from respective outer edges 42 of the sheet 16. The opposite ends 40 are sized for securing portions of the obstacle 22 extending thereunder. Accordingly, the severed length 32 provides a dual purpose in that it co-acts with the sheet 16 to create the colored perimeter 34 as well as acting to provide additional securement of the obstacle 22 so that the obstacle 22 remains in fixed position so as not to become a risk or safety concern to users walking about.

It should also be noted that the obstacle 22 could also comprise a relatively flat sheet of printed material or advertisement 22' which is placed below the sheet 16, as shown in FIG. 3, such that the colored edges 28 draw attention to the printed material 22'.

In a method of using the above described floor runner 10 for protecting a floor and alerting users thereupon of obstacles crossing a designated path, the method includes the following steps: (a) providing plastic sheeting 16 in rolled form, the plastic sheeting 16 having outer spaced apart parallel colored edges 28 extending along the length; (b) unrolling the plastic sheeting 16 along the floor 12 with adhesive 20 of the bottom surface 18 securing the plastic sheeting 16 in removable engagement with the floor 12; (c) cutting the plastic sheeting 16 to sever an unrolled portion of the plastic sheeting 16 to form a first length of the plastic sheeting 16; (d) unrolling the plastic sheeting 16 transversely across the first length of plastic sheeting 16 at a position corresponding to an obstacle 22 underlying the first length of plastic sheeting 16 with the bottom surface the plastic sheeting in lapped engagement with a top surface of the first length of the plastic sheeting; and (e) cutting the plastic sheeting 16 to sever a second unrolled portion of the plastic sheeting to form a second length of the plastic sheeting, the colored edges 28 of the first and second lengths of plastic sheeting forming a generally square-shaped colored perimeter 34 viewable by the user to alert the user of the obstacle 22 positioned therebelow.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A method of protecting a floor and alerting users thereupon of obstacles crossing a designated path, the method comprising the steps of:

(a) providing a first length of plastic sheeting having a bottom surface containing adhesive applied lengthwise thereto, the first length of plastic sheeting having outer spaced apart parallel colored edges extending along the length, the colored edges being distinguishable from the generally translucent central portion of the plastic sheeting;

(b) applying the first length of plastic sheeting along a floor with the adhesive of the bottom surface securing the plastic sheeting in removable engagement with the floor;

(c) providing a second length of plastic sheeting having a bottom surface containing adhesive applied lengthwise thereto, the second length of plastic sheeting having outer spaced apart parallel colored edges extending along the length, the colored edges being distinguishable from the generally translucent central portion of the plastic sheeting, the length of the second length of plastic sheeting being approximately as long as the width of the first length of plastic sheeting; and (d) applying the second length of plastic sheeting transversely in lapped engagement with the first length of plastic sheeting with the colored edges of the second plastic sheeting being generally perpendicular with the colored edges of the first length of plastic sheeting, the colored edges of the first and second length of plastic sheeting forming a generally square-shaped colored perimeter viewable by a user to alert the user of an obstacle positioned therebelow, the portions of the perimeter formed by colored edges of the first length of plastic sheeting being adjacent and underlying translucent portions of the second length of plastic sheeting.

2. The method of claim 1, wherein opposite ends of the second length of plastic sheeting are extended outwardly from respective outer edges of the first length of plastic sheeting, the opposite ends being sized for securing portions of the obstacle extending thereunder.

3. The method of claim 1, wherein the first and second lengths of plastic sheeting have a width of at least 20 inches.

4. A method of providing a path of travel across a floor with a floor runner where the path of travel crosses various obstacles, the method comprising the steps of:

(a) providing plastic sheeting in rolled form having a bottom surface containing adhesive applied lengthwise thereto, the plastic sheeting having outer spaced apart parallel colored edges extending along the length, the colored edges being distinguishable from the generally translucent central portion of the plastic sheeting;

(b) unrolling the plastic sheeting along a floor with the adhesive of the bottom surface securing the plastic sheeting in removable engagement with the floor, the plastic sheeting being rolled over obstacles lying in the path of travel formed between the colored edges of the plastic sheeting;

(c) cutting the plastic sheeting to sever an unrolled portion of the plastic sheeting to form a first length of the plastic sheeting engaged with the floor;

(d) unrolling the plastic sheeting transversely across the first length of plastic sheeting at a position corresponding to an obstacle underlying the first length of plastic with the bottom surface the plastic sheeting in lapped engagement with a top surface of the first length of the plastic sheeting; and (e) cutting the plastic sheeting to sever a second unrolled portion of the plastic sheeting to form a second length of the plastic sheeting, the second length of plastic sheeting having outer spaced apart parallel colored edges extending along the length, the colored edges being distinguishable from the generally translucent central portion of the second length of plastic sheeting, the colored edges of the first and second lengths of plastic sheeting forming a generally square-shaped colored perimeter viewable by a user to alert the user of the obstacle positioned therebelow.

5. The method of claim 4, wherein the portions of the perimeter formed by colored edges of the first length of plastic sheeting are positioned adjacent and underlying translucent portions of the second length of plastic sheeting.

6. The method of claim 5, wherein the length of the second length of plastic sheeting is approximately as long as the width of the first length of plastic sheeting.

7. The method of claim 4, wherein opposite ends of the second length of plastic sheeting are extended outwardly from respective outer edges of the first length of plastic sheeting, the opposite ends being sized for securing portions of the obstacle extending thereunder.

8. The method of claim 7, wherein the first and second lengths of plastic sheeting have a width of at least 20 inches.

* * * * *